US006379082B1

(12) United States Patent
Takemoto

(10) Patent No.: US 6,379,082 B1
(45) Date of Patent: Apr. 30, 2002

(54) WATER SPRINKLER FOR VIBRATING PLATE COMPACTOR

(75) Inventor: Yoshinori Takemoto, Saitama-ken (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 0 days.

(21) Appl. No.: 09/540,850

(22) Filed: Mar. 31, 2000

(30) Foreign Application Priority Data

Apr. 6, 1999 (JP) ..... 11-098494

(51) Int. Cl.[7] ..... E01C 19/30; E01C 19/35

(52) U.S. Cl. ..... 404/133.1; 404/113; 239/147; 239/159

(58) Field of Search ..... 404/133.05, 133.1, 404/113; 239/146, 147, 159, 150, 152

(56) References Cited

U.S. PATENT DOCUMENTS 3,416,417 A * 12/1968 McIlrath et al. ..... 404/113
4,113,403 A * 9/1978 Tertinek et al. ..... 404/113
4,421,435 A * 12/1983 Zemke et al. ..... 404/113
4,614,486 A * 9/1986 Bragagnini ..... 425/62
5,890,834 A * 4/1999 Waldenberger ..... 404/133.1
5,957,622 A * 9/1999 Vera-Montiel ..... 404/133.1

FOREIGN PATENT DOCUMENTS

| | | |
|---|---|---|
| DE | 296 05 664 | 8/1996 |
| JP | 06-193011 | 7/1994 |
| JP | 10-183526 | 7/1998 |

* cited by examiner

*Primary Examiner*—David Bagnell
*Assistant Examiner*—Sunil Singh
(74) *Attorney, Agent, or Firm*—Frishauf, Holtz, Goodman, Langer & Chick, P.C.

(57) ABSTRACT

A vibrating plate compactor having a vibration generator, a water tank, wherein the water tank is removably mounted on the compactor. The compactor includes a sprinkler pipe having a nozzle, a connection pipe having a switch cock and a pair of brackets projecting downward from both sides of the front of the tank. Two ends of the sprinkler pipe are connected between the brackets. A recess portion projects below the tank bottom at one part thereof at the rear of one of the brackets. The recess portion and one of the brackets are connected by the connection pipe having the switch cock.

2 Claims, 3 Drawing Sheets

WATER SPRINKLER FOR VIBRATING PLATE COMPACTOR

BACKGROUND OF THE INVENTION AND RELATED ART STATEMENT

The present invention concerns a water sprinkler for a vibrating plate compactor for compacting ground surfaces with vibration generated by a vibration generator placed on a base plate. More particularly, the invention concerns the construction of the sprinkler for supplying water to the lower side of the base plate in order to prevent adhesion of asphalt to the base plate bottom while performing compaction.

As disclosed, for instance, in Japanese Patent Kokai Hei6-193011 and Japanese Patent Kokai Hei10-183526, there are known conventional sprinklers for a vibrating plate compactor wherein a water tank is mounted above the compactor and a sprinkler nozzle is provided over the front portion of the base plate to spray water to the lower side thereof, and the tank and the sprinkler nozzle are connected by a guide tube, etc.

The above mentioned sprinkler has a switch cock on the tank bottom, and the cock and the nozzle attached to the base plate are connected by a guide tube of a considerable length. Therefore, if there is no water in the tank, the cock is closed and the tank is removed from the compactor in order to supply water from the faucet, etc. On such occasion, the connection between the tank cock and the nozzle must be removed. When mounting the tank filled with water on the compactor, it is necessary to connect the cock and the guide tube. Thus, this type of compactor needed most troublesome handling of removing and attaching the guide tube connecting the cock and the nozzle whenever water was to be supplied to the tank.

As the cock and the nozzle are connected by a relatively long tube, the tube constantly vibrates by vibrations of the compactor, and the connections between the water tank cock and the tube and the tube and the nozzle are quite easily damaged. The connection between the cock and the tube is particularly susceptible to breakage because the cock and the tube must be removed, closed, or loosened frequently whenever supplying water to the tank.

According to the above mentioned sprinkler, the sprinkler nozzle is integrally formed above the front part of the base plate. In manufacturing compactors of this type, the sprinkler nozzle must always be provided above the front of the base plate irrespective of whether or not the water sprinkler is needed for compaction. This meant an extra manufacturing stage for the compactor, and cost reduction was desired.

In a construction where a sprinkler nozzle is integrally formed above the front of the base plate, the nozzle cannot be removed even when compaction work does not require water sprinkling. When performing such work, the nozzle becomes easily clogged with sand or dirt, and cannot be used for compaction requiring water sprinkling.

SUMMARY OF THE INVENTION

In view of the problems of this type of water sprinklers, the present invention aims to offer a water sprinkler, which is easy to handle since a sprinkler pipe is formed integrally with the water tank mounted on the compactor so that it is not necessary to detach the pipe from the tank when supplying water to the tank.

For achieving such an objective, the present invention offers a vibrating plate compactor for compacting ground surfaces by vibrations generated by a vibration generator placed on the base plate, and provided with a nozzle for sprinkling water to the bottom surface of the base plate from the water tank positioned on the compactor wherein the tank is mounted on the front part of the base plate in a freely removable fashion and is provided with a sprinkler pipe at the front of the tank bottom which is positioned above and in front of the front edge of the base plate for sprinkling water to the bottom of the base plate, and the tank bottom and the water sprinkler pipe are connected by a connection tube provided with a switch cock.

According to a preferred embodiment of the present invention, a pair of brackets project downward from both sides of the front bottom of the water tank, each end of the sprinkler pipe is connected to each of these brackets, and on a part of the tank bottom at the rear of one bracket is provided a recess portion below the tank bottom, and the recess portion and one bracket are connected by a connection tube provided with a switch cock.

According to another preferred embodiment of the present invention, a pair of brackets project downward from both sides of the front bottom of the water tank, two ends of the sprinkler pipe are connected between these brackets, and the tank bottom and one bracket connected to one end of the sprinkler pipe are connected by a connection tube provided with a switch cock.

According to yet another preferred embodiment of the present invention, a pair of brackets project downward from both sides of the front bottom of the water tank, two ends of the sprinkler pipe are connected between these brackets, and the tank bottom and the pipe are connected by a connection tube provided with a switch cock.

The vibrating plate compactor provided with the present invention sprinkler may be used for compaction of asphalt-paved surfaces which requires water sprinkling to the bottom surface of the base plate by opening the switch cock of the connection tube provided between the water tank and the bracket or the sprinkler pipe, so that an adequate amount of water flows out of the nozzle holes of the sprinkler pipe and is sprinkled to the bottom of the base plate from the front edge of the base plate to facilitate adequate compaction.

The vibrating plate compactor provided with the present invention sprinkler has a pipe for sprinkling water to the bottom of the base plate on the bottom of the water tank instead of on the compactor base plate so that it is enough to close the cock, to pull up and to remove the tank from the compactor when supplying water to the tank. This simplifies water supply by eliminating troublesome handling as in the conventional type sprinkler such as removing the connection between the tank cock and the guide tube for the sprinkler nozzle, or connecting the cock and the guide tube when the water filled tank is replaced on the machine.

DETAILED DESCRIPTION OF THE PREFERRED EMBODIMENTS

Figure 1:
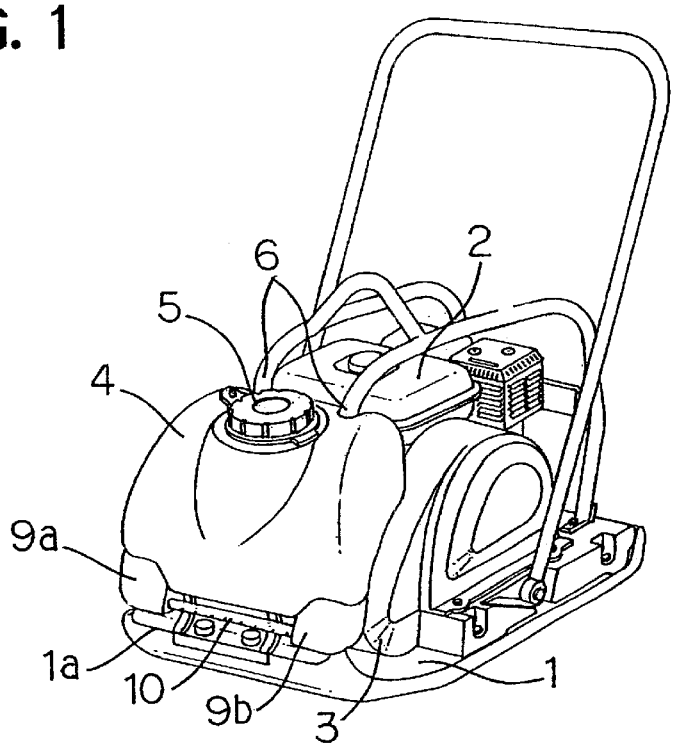
FIG. 1 is a perspective view showing the construction of a vibrating plate compactor mounted with the present invention sprinkler.
Figure 2:
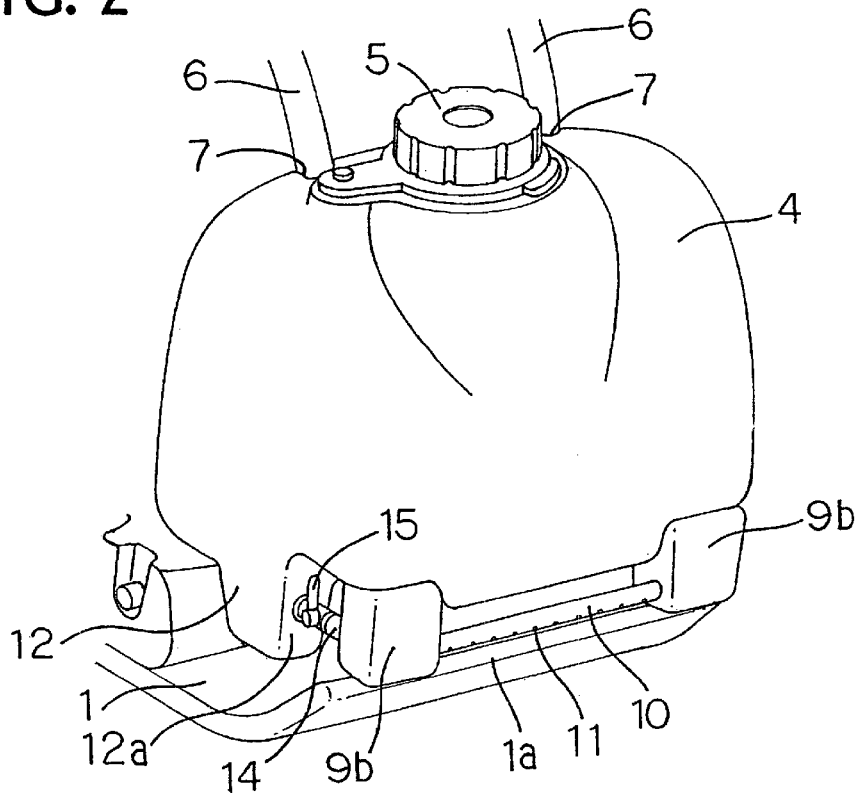
FIG. 2 is a perspective view of the water tank shown in FIG. 1.

The construction of the water sprinkler for vibrating plate compactor according to the present invention is explained by referring to embodiments shown in the drawing. As shown in FIG. 1, the vibrating plate compactor according to the present invention transmits rotation of an engine 2 on a base plate 1 to a vibration generator 3 placed at the front of the base plate 1 and performs compaction of road surfaces with vibrations of the vibration generator 3, and has a water tank 4 constituting a sprinkler above the vibration generator 3 at the front of the base plate 1.

Figure 3:
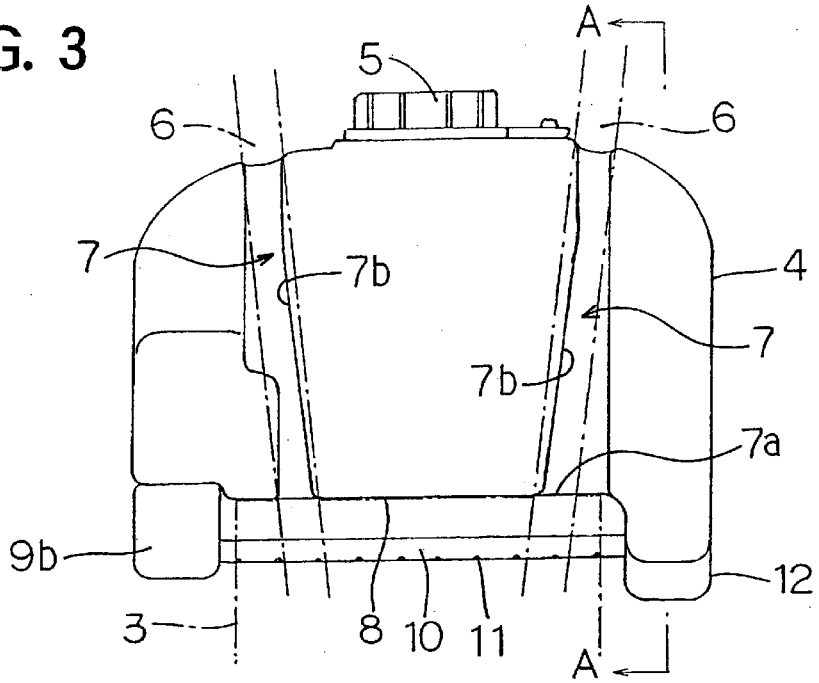
FIG. 3 is a back view of the water tank shown in FIG. 1.

The tank 4 is made of synthetic resin such as polyethylene and has an opening which is closed by a cap 5 at the top, and a pair of vertical frame supports 6 on the left and the right at the front of the compactor body and concave grooves 7 into which the supports 6 are fitted in a freely removable fashion as shown in FIG. 3.

Figure 6:
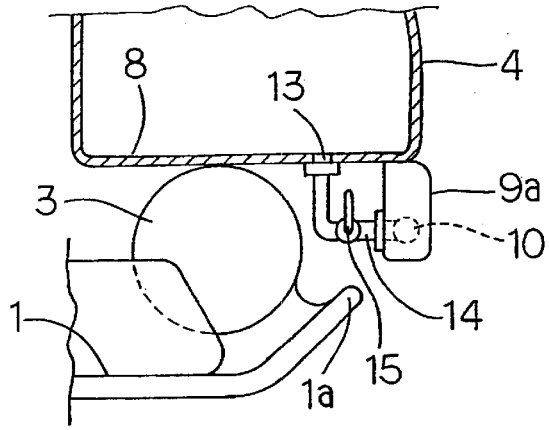
FIG. 6 is a cross section of another embodiment of the water tank.

The interval between the left and the right frame supports 6 is wider at the top and narrower at the bottom when looking from the engine 2 at the back of the tank 4. As shown in FIG. 6, when the machine body is seen from the side, the top portion bends forward from the center of the compactor body, and the lower portion stands upright.

One edge of the concave grooves 7 provided at the back of the tank 4 is inclined parallel to the angle of inclination of the frame supports 6 so that the groove width at the lower end 7*a* becomes gradually wider than at the upper end, and said inclined edge of the groove 7 has a projecting edge 7*b* to embrace and engage the frame support 6. When the tank 4 is dropped down along the frame supports 6 in such a way that the concave grooves 7 on the back face the frame supports 6, the tank 4 is engaged securely with the frame supports 6 via the concave grooves 7 and mounted on the vibration generator 3, and when the tank 4 is pulled upward from this position, the concave grooves 7 become detached from the frame supports 6 and the tank can be removed outside.

Figure 4:
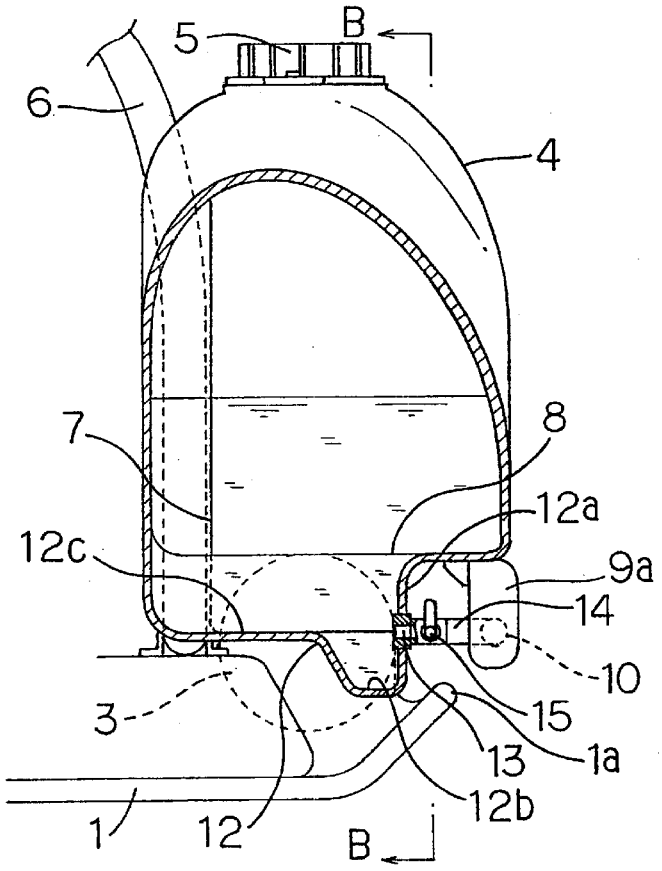
FIG. 4 is a cross section along the line A—A in FIG. 3.
Figure 5:
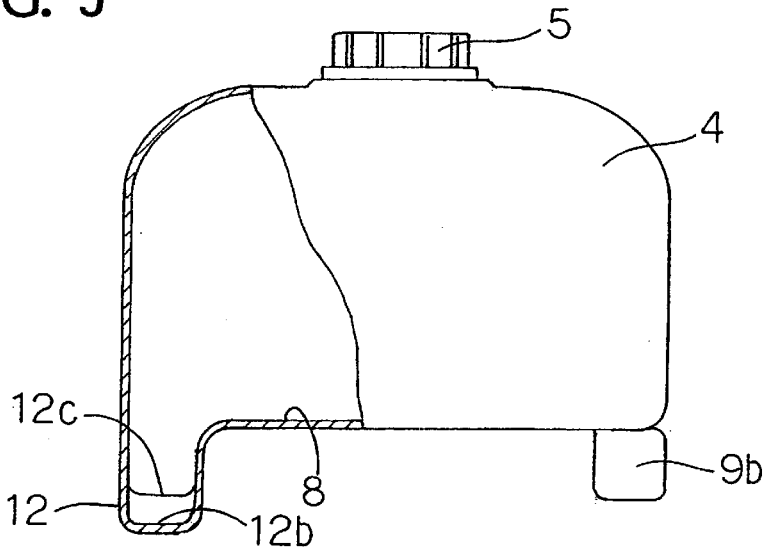
FIG. 5 is a cross section along the line B—B in FIG. 4.

As shown in FIG. 4, the front of the water tank 4 projects above the front edge 1*a* of the base plate 1. On both sides of the front portion of the bottom 8 of the tank 4 are provided a pair of brackets 9*a*, 9*b* projecting downward, and two ends of the sprinkler pipe 10 having holes 11 are connected between these brackets 9*a*, 9*b*, so that the sprinkler pipe 10 is placed horizontally above the front edge 1*a* of the base plate 1. The brackets 9*a*, 9*b* are hollow blocks of synthetic resin molded separately from the tank 4 and attached to the bottom of the front part of the tank 4 on both sides, but they may be molded integrally with the tank 4. The brackets 9*a*, 9*b* do not necessarily have to be made of synthetic resin blocks but may be metallic cylinders.

As shown in FIGS. 2 through 5, there is provided a recessed portion 12 with its front 12*a* facing the back of the bracket 9*a* by projecting the bottom 12*b* below the tank bottom 8 on the rear side of one of the brackets 9*a*. A connection tube 14 provided with a switch cock 15 is connected between the hole 13 bore in the front part 12*a* of the recessed portion 12 and the back of the bracket 9*a*, and when the cock 15 is opened, water from the tank 4 passes through the connection tube 14 and flows into the sprinkler pipe 10.

As shown in FIG. 4, the depth of the bottom 12*b* of the recessed portion 12 is set so that the height of the front 12*a* having the hole 13 is made substantially equal or somewhat bigger than the height of the bracket 9*a* to allow joining of the connection tube 14 having a cock between the front part 12*a* and the bracket 9*a*. It is sufficient for the bottom 12*b* of the recessed portion 12 to be provided only at the part adjacent to the front part 12*a*, and the bottom 12*c* at the rear (left) may be shallower than that.

FIG. 6 shows another embodiment wherein the tank bottom 8 is entirely flat without the recessed portion 12 shown in the above-mentioned embodiment. A part of the tank bottom 8 close to one bracket 9*a* and the bracket 9*a* are connected by the connection tube 14 having the cock 15.

Figure 7:
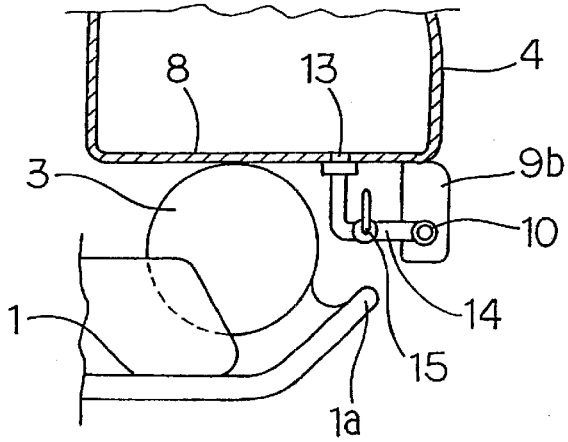
FIG. 7 is a cross section of yet another embodiment of the water tank.

If the tank bottom 8 was made entirely flat as shown in FIG. 6, the connection tube 14 having the cock 15 maybe connected between a part of the tank bottom 8 and the sprinkler pipe 10 instead of between a part of the tank bottom 8 and one of the brackets 9*a* as shown in respect of another embodiment in FIG. 7.

Although not shown, the sprinkler pipe may be attached below the water tank by projecting the pair of brackets 9*a*, 9*b* from both sides of the lower front of the tank 4 instead of projecting the brackets 9*a*, 9*b* downward from both sides of the front of the tank bottom 8, so that the sprinkler pipe 10 projects outwardly from the lower front of the tank 4 by the brackets 9*a*, 9*b*, and the connection tube 14 having the cock 15 between the lower front of the tank 4 and the sprinkler pipe 10 may be connected between the lower front of the tank 4 and either of the brackets 9*a* or 9*b*.

When compacting asphalt-paved surfaces, etc., it is necessary to sprinkle water over the bottom of the base plate 1. In such a case, the cock 15 of the connection tube 14, which is provided between the water tank 4 and one of the brackets 9*a* or 9*b* or between the tank 4 and the sprinkler pipe 10, is opened to sprinkle an optimum amount of water flowing out of the nozzle holes 11 of the pipe 10 from the front edge 1*a* of the base plate 1 to the bottom face of the base plate.

The sprinkler mentioned above has a pipe 10 for sprinkling water to the bottom of the base plate, which is integrally formed with the tank 4 without the base plate. When supplying water to the empty tank 4, the tank 4 may simply be removed after closing the cock 15 instead of removing the connection part between the cock and the guide tube of the sprinkler nozzle and connecting the cock and the tube when the water filled tank is to be mounted again on the machine. Thus, troublesome handling of removing and mounting the water tank is not required, and the water supply operation is simplified.

The sprinkler according to this invention has a pair of brackets 9*a*, 9*b* projecting from both sides of the front of the water tank bottom 8, and connects the water pipe 10 horizontally between the brackets 9*a*, 9*b*. Thus, a short connection tube 14 provided with a cock 15 may be used to connect the pipe 10 and the tank bottom 8. As a result, prior problems of constant swaying of the guide tube and frequent damages to the connecting part of the long tube between the cock and the nozzle on the base plate can be obviated.

As illustrated by the embodiments, in the structure where a pair of brackets 9*a*, 9*b* project from both sides of the front of the tank bottom 8 and both ends of the sprinkler pipe 10 are connected by the brackets 9*a*, 9*b*, not only the pipe 10 can be positioned above the front edge 1*a* of the base plate for easy sprinkling, but also the receded portion 12 projecting downward below the tank bottom 8 may be provided on one side of the tank bottom 8. This facilitates connection of a shorter connection pipe 14 between the front part 12*a* of the receded portion 12 and the bracket 9*a* to minimize damages and enables opening and closing of the cock 15 from outside as it is provided on the lower side of the tank 4.

In a construction where the receded portion 12 projecting below the tank bottom 8 is provided on one side of the bottom 8 and a connection pipe 14 having a cock 15 is connected between the receded portion 12 and the bracket 9*a*, the tank 4 may be placed on the ground temporarily or in a storehouse after removing from the machine with the receded portion 12 and the bracket 9*a* acting to prevent the cock 15 from directly contacting the floor or the shelf and becoming damaged since the portion 12 and the bracket 9*a* contact the floor and the shelf and act as buffers.

In a construction where a pair of brackets 9*a*, 9*b* are provided projecting from both sides of the front of the tank bottom 8 and both sides of the sprinkler pipe 10 are connected with the brackets 9*a*, 9*b*, the pipe 10 does not project beyond the tank 4 and is protected even when the compactor crashes into the curb of the pedestrian walk or the wall.

A conventional water sprinkler has a construction where the sprinkler nozzle is integrally attached to the top front of the base plate, and compactor manufacturers had to attach the sprinkler nozzles above the base plate irrespective of whether or not the compactor was to be used for works requiring water sprinkling. According to the present invention sprinkler, the sprinkler pipe is incorporated with the tank, thereby eliminating a manufacture stage of attaching sprinkler nozzles to the compactor and decreasing the cost.

Sprinkler nozzles of a conventional water sprinkler are easily clogged with sands or dirt when the compactor is used for work not requiring water sprinkling and create difficulties when water sprinkling is needed. The present invention water sprinkler can be removed from the tank when water sprinkling is not needed so that the sprinkler pipes may be maintained in adequate condition at all times.

What is claimed is:

1. A vibrating plate compactor for compacting ground surfaces with vibration comprising:

a vibration generator positioned on a base plate, a nozzle for sprinkling water to a bottom of the base plate from a water tank positioned on the compactor body in order to prevent adhesion of asphalt to the bottom surface of the base plate while the vibrating plate compactor is performing compaction, the water tank being removably mounted above the base plate, said tank having a sprinkler pipe coupled to the nozzle for sprinkling water to the bottom of the base plate in front of said bottom positioned above the front edge of the base plate, and said tank bottom and said sprinkler pipe are connected by a connection tube having a switch cock, wherein a pair of brackets project downward from both sides of the front of the tank bottom, two ends of the sprinkler pipe are connected between the brackets, and a receded portion projects below the tank bottom at one part thereof at the rear of one of the brackets, and said receded portion and one of the brackets are connected by the connection tube having the switch cock.

2. A vibrating plate compactor for compacting ground surfaces with vibration comprising:

a base plate;

a vibration generator coupled to the base plate;

a water tank for storing water therein;

a nozzle for sprinkling water to a bottom of the base plate in order to prevent adhesion of asphalt to the bottom of the base plate while the vibrating plate compactor is performing compaction, wherein the water tank is removably mounted above the base plate, the water tank including a sprinkler pipe coupled to the nozzle for sprinkling water to the bottom of the base plate in front of said bottom positioned above the front edge of the base plate, the bottom of the water tank and said sprinkler pipe being coupled by a connection tube having a switch cock, and wherein a pair of brackets project downward from both sides of the front of the bottom of the water tank, two ends of the sprinkler pipe are connected between the brackets, and a receded portion projects below the bottom of the water tank at one part thereof at the rear of one of the brackets, and said receded portion and said one of the brackets are connected by the connection tube having the switch cock.

* * * * *